US007294070B2

(12) United States Patent
Manami et al.

(10) Patent No.: US 7,294,070 B2
(45) Date of Patent: Nov. 13, 2007

(54) GOLF BALL

(75) Inventors: Toshihiko Manami, Chichibu (JP); Hideo Watanabe, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 5 days.

(21) Appl. No.: 11/264,001

(22) Filed: Nov. 2, 2005

(65) Prior Publication Data

US 2007/0099728 A1 May 3, 2007

(51) Int. Cl.
*A63B 37/12* (2006.01)

(52) U.S. Cl. ..... 473/378

(58) Field of Classification Search ..... 473/378, 473/351

See application file for complete search history.

(56) References Cited

U.S. PATENT DOCUMENTS 5,693,711 A * 12/1997 Akiba et al. ..... 525/93
6,194,505 B1 2/2001 Sone et al.
6,232,400 B1 5/2001 Harris et al.
6,613,843 B2 9/2003 Takesue et al.
6,616,552 B2 9/2003 Takesue et al.
6,642,314 B2 11/2003 Sone et al.
2004/0147694 A1 7/2004 Sone et al.
2006/0089419 A1* 4/2006 Hogge et al. ..... 522/174
2006/0211518 A1* 9/2006 Sullivan et al. ..... 473/373

FOREIGN PATENT DOCUMENTS

JP 10-231400 A 9/1998
JP 11-35633 A 2/1999
JP 11-164912 A 6/1999
JP 2002-293996 A 10/2002
JP 2004-231746 A 8/2004

* cited by examiner

*Primary Examiner*—Raeann Trimiew
(74) *Attorney, Agent, or Firm*—Sughrue Mion Pllc.

(57) ABSTRACT

In a golf ball having a core and a cover of one or more layer which encloses the core, at least one cover layer is made primarily of a mixture of (A) a thermoplastic resin or thermoplastic elastomer and (B) a polyacetal. The golf ball has an excellent durability to repeated impact, and improved resistance to both scuffing and discoloration.

18 Claims, No Drawings

GOLF BALL

BACKGROUND OF THE INVENTION

The present invention relates to golf balls such as two-piece solid golf balls or three-piece solid golf balls which are composed of a core enclosed by a cover of one or more layers.

Various cover materials consisting largely of ionomer resins have been disclosed in the prior art. Such cover materials are often intended to provide the golf ball with a higher rebound and an increased carry. In this connection, reference may be made to many known documents, including U.S. Pat. No. 6,616,552, U.S. Pat. No. 6,613,843, U.S. Pat. No. 6,232,400, JP-A 10-231400 and JP-A 2004-231746.

However, when the hardness of the ionomer resin used as the cover material is increased, the durability of the golf ball to repeated impact often diminishes. Hence, in prior-art golf balls, it has been difficult to achieve both a good rebound resilience and a good durability to impact.

Aside from the problem of durability to repeated impact, such golf balls have had a poor scuff resistance, with fraying and scuffing of the ball surface often arising. In addition, when the ball is used over an extended period of time, it has a tendency to discolor. In particular, because white is often used as the surface color in golf balls, even slight yellowing or other discoloration of the ball surface will lower the quality of the ball and make it unattractive. A need thus exists for a solution to such problems.

SUMMARY OF THE INVENTION

The object of the invention is to provide a golf ball which has an excellent durability to repeated impact, and also has improved resistance to both scuffing and discoloration.

As a result of extensive investigations, I have found that golf balls which satisfy the above object can be achieved by having, in a golf ball composed of a core enclosed by one or more cover layer, at least one cover layer made primarily of a mixture of (A) a thermoplastic resin or thermoplastic elastomer and (B) a polyacetal.

Accordingly, the invention provides the following golf balls.

[1] A golf ball composed of a core and a cover of one or more layer which encloses the core, the ball being characterized in that at least one cover layer is made primarily of a mixture of (A) a thermoplastic resin or thermoplastic elastomer and (B) a polyacetal.

[2] The golf ball of above [1], wherein component (A) is an ionomer resin.

[3] The golf ball of above [1], wherein component (A) and component (B) are mixed in a ratio by weight of from 99:1 to 80:20.

[4] The golf ball of above [1], wherein the cover of one or more layer has an outermost layer which is made of a cover material made primarily of the mixture of components (A) and (B).

[5] The golf ball of above [4], wherein the polyacetal used as component (B) accounts for 1 to 20 wt % of resin components in the cover material.

[6] The golf ball of above [1] which, when irradiated for 24 hours with a mercury vapor lamp, has a degree of fading $\Delta E$ of at most 2.00.

DETAILED DESCRIPTION OF THE INVENTION

The invention is described more fully below.

The invention provides a golf ball composed of a core and a cover of one or more layer which encloses the core. At least one layer of the cover is made primarily of a mixture of (A) a thermoplastic resin or thermoplastic elastomer and (B) a polyacetal.

The core can be made from a rubber composition which includes such ingredients as a co-crosslinking agent, an organic peroxide, an inert filler and an organosulfur compound. The base rubber in the rubber composition is preferably a polybutadiene.

It is advantageous for the polybutadiene used as the rubber component to have on the polymer chain thereof a cis-1,4 bond content of at least 60 wt %, preferably at least 80 wt %, more preferably at least 90 wt %, and most preferably at least 95 wt %. If cis-1,4 bonds account for too low a proportion of the bonds on the polybutadiene molecule, the rebound of the golf ball may decrease.

The polybutadiene has a 1,2-vinyl bond content, based on the polymer chain, of generally 2% or less, preferably 1.7% or less, and more preferably 1.5% or less. If the 1,2-vinyl bond content is too high, the resilience may decrease.

To obtain a vulcanized molding of the rubber composition having a good resilience, the above-described polybutadiene used in the invention is preferably synthesized with a rare earth catalyst or a group VIII metal compound catalyst, and most preferably synthesized with a rare-earth catalyst.

The rare-earth catalyst is not subject to any particular limitation. Illustrative examples include catalysts made up of a combination of a lanthanide series rare-earth compound, an organoaluminum compound, an alumoxane, a halogen-bearing compound and an optional Lewis base.

Examples of suitable lanthanide series rare-earth compounds include halides, carboxylates, alcoholates, thioalcoholates and amides of atomic number 57 to 71 metals.

In the practice of the invention, the use of a neodymium catalyst in which a neodymium compound serves as the lanthanide series rare-earth compound is particularly advantageous because it enables a polybutadiene rubber having a high cis-1,4 content and a low 1,2-vinyl content to be obtained at an excellent polymerization activity. Suitable examples of such rare-earth catalysts include those mentioned in JP-A 11-35633, JP-A 11-164912 and JP-A 2002-293996.

To enhance the resilience, it is preferable for the polybutadiene synthesized using the lanthanide series rare-earth compound catalyst to account for at least 10 wt %, preferably at least 20 wt %, and most preferably at least 40 wt %, of the rubber components.

Rubber components other than the above-described polybutadiene may be included in the base rubber insofar as the objects of the invention are attainable. Illustrative examples of rubber components other than the above-described polybutadiene include other polybutadienes, and other diene rubbers such as styrene-butadiene rubber, natural rubber, isoprene rubber and ethylene-propylene-diene rubber.

Examples of co-crosslinking agents include unsaturated carboxylic acids and the metal salts of unsaturated carboxylic acids.

Specific examples of unsaturated carboxylic acids include acrylic acid, methacrylic acid, maleic acid and fumaric acid. Acrylic acid and methacrylic acid are especially preferred.

The metal salts of unsaturated carboxylic acids, while not subject to any particular limitation, are exemplified by the above-mentioned unsaturated carboxylic acids neutralized with a desired metal ion. Specific examples include the zinc and magnesium salts of methacrylic acid and acrylic acid. The use of zinc acrylate is especially preferred.

The unsaturated carboxylic acid and/or metal salt thereof is included in an amount, per 100 parts by weight of the base rubber, of generally at least 10 parts by weight, preferably at least 15 parts by weight, and more preferably at least 20 parts by weight, but generally not more than 60 parts by weight, preferably not more than 50 parts by weight, more preferably not more than 45 parts by weight, and most preferably not more than 40 parts by weight. Too much may make the core too hard, giving the ball an unpleasant feel on impact, whereas too little may lower the rebound of the ball.

The organic peroxide may be a commercially available product, suitable examples of which include Percumil D (produced by NOF Corporation), Perhexa 3M (NOF Corporation), and Luperco 231XL (Atochem Colo.). These may be used singly or as combinations of two or more thereof.

The amount of organic peroxide included per 100 parts by weight of the base rubber is generally at least 0.1 part by weight, preferably at least 0.3 part by weight, more. preferably at least 0.5 part by weight, and most preferably at least 0.7 part by weight, but generally not more than 5 parts by weight, preferably not more than 4 parts by weight, more preferably not more than 3 parts by weight, and most preferably not more than 2 parts by weight. Too much or too little organic peroxide may make it impossible to achieve a ball having suitable feel on impact, durability and rebound.

Examples of suitable inert fillers include zinc oxide, barium sulfate and calcium carbonate. These may be used singly or as combinations of two or more thereof.

The amount of inert filler included per 100 parts by weight of the base rubber is generally at least 1 part by weight, and preferably at least 5 parts by weight, but generally not more than 50 parts by weight, preferably not more than 40 parts by weight, more preferably not more than 30 parts by weight, and most preferably not more than 20 parts by weight. Too much or too little inert filler may make it impossible to achieve a proper weight and a suitable rebound.

In addition, an antioxidant may be included if necessary. Illustrative examples of commercial antioxidants include Nocrac NS-6, Nocrac NS-30 (both available from Ouchi Shinko Chemical Industry Co., Ltd.), or Yoshinox 425 (available from Yoshitomi Pharmaceutical Industries, Ltd.). These may be used singly or as a combination of two or more thereof.

The amount of antioxidant included per 100 parts by weight of the base rubber is generally 0 or more part by weight, preferably at least 0.05 part by weight, more preferably at least 0.1 part by weight, and most preferably at least 0.2 part by weight, but generally not more than 3 parts by weight, preferably not more than 2 parts by weight, more preferably not more than 1 part by weight, and most preferably not more than 0.5 part by weight. Too much or too little inert antioxidant may make it impossible to achieve a suitable rebound and durability.

To enhance the rebound of the golf ball and increase its initial velocity, it is preferable to include within the core an organosulfur compound.

No particular limitation is imposed on the organosulfur compound, provided it improves the rebound of the golf ball. Exemplary organosulfur compounds include thiophenols, thionaphthols, halogenated thiophenols, and metal salts thereof. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol; and diphenylpolysulfides, dibenzylpolysulfides, dibenzoylpolysulfides, dibenzothiazoylpolysulfides and dithiobenzoylpolysulfides having 2 to 4 sulfurs. Diphenyldisulfide and the zinc salt of pentachlorothiophenol are especially preferred.

To enhance the rebound of the golf ball and increase its initial velocity, it is preferable to include within the core an organosulfur compound.

It is recommended that the amount of the organosulfur compound included per 100 parts by weight of the base rubber be generally at least 0.05 part by weight, and preferably at least 0.1 part by weight, but generally not more than 5 parts by weight, preferably not more than 4 parts by weight, more preferably not more than 3 parts by weight, and most preferably not more than 2.5 parts by weight. If too much organosulfur compound is included, the effects of addition may peak so that further addition has no apparent effect, whereas the use of too little organosulfur compound may fail to confer the effects of such addition to a sufficient degree.

It is preferable for the core to have a diameter of generally at least 36.7 mm, and especially at least 37.0 mm, but generally not more than 40.5 mm, and especially not more than 38.5 mm. In addition, it is preferable for the core to have a weight of generally 30 to 36 g, and especially 31 to 34 g.

Here, the core, within the above diameter range, has a compressive deflection when subjected to loading from an initial load of 10 kgf to a final load of 130 kgf (hardness under loading from 10 to 130 kgf) of at least 2 mm, and preferably at least 3 mm, but not more than 6 mm, and preferably not more than 5 mm. If the amount of deformation is too small, the ball will have a hard feel on impact. In addition, the spin rate will increase, which may shorten the carry of the ball when hit at a low head speed with a driver (W#1) or when struck with an iron. On the other hand, if the amount of deformation is too large, the durability of the ball to cracking on repeated impact may worsen and the rebound may decrease, resulting in a shorter than desirable carry.

The type of core used in the inventive golf ball is not subject to any particular limitation. Examples of various cores that may be used include solid cores for two-piece balls, solid cores having a plurality of vulcanized rubber layers, solid cores having a plurality of resin layers, and thread-wound cores having a rubber thread layer.

The core may be formed by a method in which a rubber composition composed primarily of the above-described base rubber is vulcanized and cured by a known method to give a spherical vulcanized and molded core. Vulcanization is typically carried out at a temperature of 100 to 200° C. and over a period of 10 to 40 minutes.

Next, in the present invention, at least one layer of the cover of one or more layer which encloses the core is made primarily of a mixture of (A) a thermoplastic resin or thermoplastic elastomer and (B) a polyacetal. Components A and B are described below.

(A) Thermoplastic Resin Composition and Thermoplastic Elastomer

The primary materials that may be used in the cover of the inventive golf ball are preferably one or more selected from among thermoplastic block copolymers, polyester elastomers, polyamide elastomers, polyurethane elastomers and ionomer resins. The use of an ionomer resin is especially preferred.

Suitable thermoplastic block copolymers include those in which the hard segments are made of crystalline polyethylene blocks (C) and/or crystalline polystyrene blocks (S); and the soft segments are made of polybutadiene blocks (B), polyisoprene blocks (I), blocks of a relatively random copolymer of ethylene and butylene (EB) or blocks of a relatively random copolymer of ethylene and propylene (EP), preferably blocks of a relatively random copolymer of ethylene and butylene (EB) or blocks of a relatively random copolymer of ethylene and propylene (EP), and most preferably blocks of a relatively random copolymer of ethylene and butylene (EB).

Illustrative examples of such thermoplastic block copolymers include S-EB-S, S-B-S, S-I-S, S-EB, S-EB-S-EB, S-EP-S, S-EB-C, S-B-C, S-I-C, S-EP-C, C-EB-C, C-B-C, C-I-C, C-EB, C-EB-C-EB, and C-EP-C. Selecting crystalline polystyrene blocks (S) as the hard segments is advantageous from the standpoint of moldability, and including crystalline polyethylene blocks (C) as the hard segments is advantageous from the standpoint of rebound.

If the thermoplastic block copolymer is a C-EB-C or S-EB-C type block copolymer, it can be obtained by hydrogenating butadiene or a styrene-butadiene copolymer.

A polybutadiene in which bonding within the butadiene structure is characterized by the presence of block-like 1,4-polymer regions having a 1,4-bond content of at least 95 wt %, and in which the butadiene structure as a whole has a 1,4-bond content of at least 50 wt %, and preferably at least 80 wt %, may be suitably used here as the polybutadiene or styrene-butadiene copolymer in hydrogenation.

The degree of hydrogenation (conversion of double bonds in the polybutadiene or styrene-butadiene copolymer to saturated bonds) in the hydrogenate is preferably 60 to 100%, and more preferably 90 to 100%. Too low a degree of hydrogenation may give rise to undesirable effects such as gelation in the blending step with other components such as an ionomer resin and, when the golf ball is formed, may compromise the weather resistance and durability to impact of the cover.

In the thermoplastic block copolymer, the content of the hard segments is preferably from 10 to 50 wt %, and more preferably from 15 to 50 wt %. If the content of hard segments is too high, the cover may lack sufficient flexibility, making it difficult to effectively achieve the objects of the invention. On the other hand, if the content of hard segments is too low, the blend may have a poor moldability.

The thermoplastic block copolymer has a number-average molecular weight of preferably from 30,000 to 800,000.

The thermoplastic block copolymer has a melt index at 230° C. of preferably 0.5 to 15 g/10 min, and more preferably 1 to 7 g/10 min. Outside of this range, problems such as weld lines, sink marks and short shots may arise during injection molding.

The polyester elastomer is constructed primarily of hard segments made of a high-melting crystalline polymer composed of crystalline aromatic polyester units, and soft segments made of low-melting polymer segments composed of aliphatic polyether units and/or aliphatic polyester units.

Preferred examples of the high-melting crystalline polymer include polybutylene terephthalates derived from terephthalic acid and/or dimethyl terephthalate in combination with 1,4-butanediol. Other illustrative examples include polyesters derived from a dicarboxylic acid component such as isophthalic acid, phthalic acid, naphthalene-2,6-dicarboxylic acid, naphthalene-2,7-dicarboxylic acid, diphenyl-4,4'-dicarboxylic acid, diphenoxyethanedicarboxylic acid, 5-sulfoisophthalic acid, or ester-forming derivatives thereof in combination with a diol having a molecular weight of up to 300, such as an aliphatic diol (e.g., ethylene glycol, trimethylene glycol, pentamethylene glycol, hexamethylene glycol, neopentyl glycol, decamethylene glycol), alicyclic diol (e.g., 1,4-cyclohexanedimethanol, tricyclodecanedimethylol), or aromatic diol (e.g., xylylene glycol, bis(p-hydroxy)diphenyl, bis(p-hydroxyphenyl)propane, 2,2-bis[4-(2-hydroxyethoxy)phenyl]propane, bis[4-(2-hydroxy)-phenyl]sulfone, 1,1-bis[4-(2-hydroxyethoxy)phenyl] cyclohexane, 4,4'-dihydroxy-p-terphenyl, and 4,4'-dihydroxy-p-quarterphenyl). Use can also be made of any copolymeric polyester prepared from two or more of these dicarboxylic acid components and diol components. In addition, polycarboxylic acid components, polyoxy acid components and polyhydroxy components having a functionality of three or more can be copolymerized therein within a range of up to 5 mol %.

As noted above, the low-melting polymer segments are composed of aliphatic polyether units and/or aliphatic polyester units.

Illustrative examples of the aliphatic polyether include poly(ethylene oxide) glycol, poly(propylene oxide) glycol, poly(tetramethylene oxide) glycol, poly(hexamethylene oxide) glycol, copolymers of ethylene oxide and propylene oxide, ethylene oxide addition polymers of poly(propylene oxide) glycols, and copolymers of ethylene oxide and tetrahydrofuran.

Illustrative examples of the aliphatic polyester include poly(ϵ-caprolactone), polyenantholactone, polycaprylolactone, poly(butylene adipate) and poly(ethylene adipate).

In terms of the elastic properties of the resulting polyester block copolymer, poly(tetramethylene oxide) glycol, ethylene oxide addition polymers of poly(propylene oxide) glycol, poly(ϵ-caprolactone), poly(butylene adipate) and poly (ethylene adipate) are preferred. Poly(tetramethylene oxide) glycol is especially preferred.

The low-melting polymer segments have a number-average molecular weight in the copolymerized state of preferably about 300 to 6,000.

Letting the combined amount of high-melting crystalline polymer segments and low-melting polymer segments which are copolymerized to form the polyester elastomer of the invention be 100 wt %, it is advantageous for the polyester elastomer to include generally at least 15 wt %, and preferably at least 50 wt %, but not more than 90 wt %, of the low-melting polymer segments. At a proportion of low-melting polymer segments higher than the above range, adequate melt characteristics suitable for injection molding may not be attainable, which can make it difficult to achieve uniform mixture during melt blending with the other components. On the other hand, if the proportion is too low, sufficient flexibility and rebound may not be achieved.

The polyester elastomer of the invention is a copolymer composed primarily of the above-described high-melting crystalline polymer segments and low-melting polymer segments. Any suitable known method may be used without particular limitation to prepare the polyester elastomer. Examples of preferred methods of preparation include methods (i) to (v) below.

(i) A method in which a lower alcohol diester of a dicarboxylic acid, an excess amount of low-molecular weight glycol, and the low-melting polymer segment components are subjected to transesterification in the presence of a catalyst, and the resulting reaction products are polycondensed.

(ii) A method in which a dicarboxylic acid, an excess amount of a glycol and the low-melting polymer segment components are subjected to esterification in the presence of a catalyst, and the resulting reaction products are polycondensed.

(iii) A method in which first the high-melting crystalline segments are prepared, then the low-melting segment components are added thereto and subjected to a transesterification reaction to effect randomization.

(iv) A method in which the high-melting crystalline segments and the low-melting polymer segments are joined together using a chain linking agent.

(v) In cases where poly(ε-caprolactone) is used as the low-melting polymer segments, a method in which the high-melting crystalline segments are subjected to an addition reaction with ε-caprolactone monomer.

It is recommended that the polyester elastomer of the invention have a hardness, as measured in accordance with ASTM D-2240 (Shore D hardness), of generally at least 10, and preferably at least 20, but not more than 50, and preferably not more than 40.

Moreover, it is advantageous for the rebound resilience, as measured in accordance with British Standard 903 (BS 903), to be a high value of generally at least 40%, and preferably at least 50%, but not more than 90%. If the material has too low a rebound resilience, moldings of the resin composition described herein will have a low rebound, which may diminish the flight performance of golf balls made therewith.

It is desirable for the flexural rigidity, as measured in accordance with JIS K-7106, to be relatively low, with a value of generally at least 5 MPa, preferably at least 10 MPa, and more preferably at least 15 MPa, but not more than 250 MPa, preferably not more than 200 MPa, and even more preferably not more than 150 MPa. If the flexural rigidity is too high, the resin composition moldings of the invention will be too rigid, which may worsen the feel on impact and durability of golf balls made therewith.

The polyamide elastomer is a thermoplastic elastomer which has on the molecule both hard segments composed of polyamide and soft segments composed of polyether.

Specific examples of thermoplastic polyamide elastomers include the product commercially available from Daicel Fuels under the trade name Daiamid PAE.

The thermoplastic polyurethane material has a morphology which includes soft segments composed of a polymeric polyol (polymeric glycol) and hard segments composed of a chain extender and a diisocyanate. The polymeric polyol used as a starting material may be any that is employed in the art relating to thermoplastic polyurethane materials, without particular limitation. Exemplary polymeric polyols include polyester polyols and polyether polyols, although polyether polyols are better than polyester polyols for synthesizing thermoplastic polyurethane materials that provide a high rebound resilience and have excellent low-temperature properties. Suitable polyether polyols include polytetramethylene glycol and polypropylene glycol. Polytetramethylene glycol is especially preferred for achieving a good rebound resilience and good low-temperature properties. The polymeric polyol has an average molecular weight of preferably 1,000 to 5,000. To synthesize a thermoplastic polyurethane material having a high rebound resilience, an average molecular weight of 2,000 to 4,000 is especially preferred.

Preferred chain extenders include those used in the prior art relating to thermoplastic polyurethane materials. Illustrative, non-limiting examples include 1,4-butylene glycol, 1,2-ethyelne glycol, 1,3-butanediol, 1,6-hexanediol, and 2,2-dimethyl-1,3-propanediol. These chain extenders have an average molecular weight of preferably 20 to 15,000.

Diisocyanates suitable for use include those employed in the prior art relating to thermoplastic polyurethane materials. Illustrative, non-limiting, examples include aromatic diisocyanates such as 4,4'-diphenylmethane diisocyanate, 2,4-toluene diisocyanate and 2,6-toluene diisocyanate; and aliphatic diisocyanates such as hexamethylene diisocyanate. Depending on the type of isocyanate used, the crosslinking reaction during injection molding may be difficult to control. In the present invention, it is most preferable to use an aromatic diisocyanate, and specifically 4,4'-diphenylmethane diisocyanate.

The most preferred thermoplastic polyurethane material in the invention is a thermoplastic polyurethane material synthesized using a polyether polyol and an aromatic diisocyanate, wherein the polyether polyol is polytetramethylene glycol having an average molecular weight of at least 2,000 and the aromatic diisocyanate is 4,4'-diphenylmethane diisocyanate.

A commercial product may be suitably used as the above-described thermoplastic polyurethane material. Illustrative examples include Pandex T-8290, Pandex T-8295 and Pandex T-8260 (all manufactured by DIC Bayer Polymer, Ltd.), and Resamine 2593 and Resamine 2597 (both manufactured by Dainichi Seika Colour & Chemicals Mfg. Co., Ltd.).

The ionomer resin may be any that has hitherto been used as a cover material in golf balls, although it is preferable to use an ionomer resin containing (1) a metal ion neutralization product of an olefin-unsaturated carboxylic acid random bipolymer and/or an olefin-unsaturated carboxylic acid random bipolymer, and (2) a metal ion neutralization product of an olefin-unsaturated carboxylic acid-unsaturated carboxylic acid ester random terpolymer and/or an olefin-unsaturated carboxylic acid-unsaturated carboxylic acid ester random terpolymer.

The olefins in component (1) and component (2) are preferably α-olefins. Specific examples of α-olefins include ethylene, propylene and 1-butene. Of these, ethylene is especially preferred. A plurality of such olefins may be used in combination.

The unsaturated carboxylic acids in component (1) and component (2) are preferably α,β-unsaturated carboxylic acids having 3 to 8 carbon atoms. Specific examples of α,β-unsaturated carboxylic acids having 3 to 8 carbons include acrylic acid, methacrylic acid, ethacrylic acid, itaconic acid, maleic acid and fumaric acid. Of these, acrylic and methacrylic acid are preferred. A plurality of these unsaturated carboxylic acids may be used in combination.

The unsaturated carboxylic acid ester in component (2) is preferably a lower alkyl ester of the foregoing unsaturated carboxylic acid. Examples include those obtained by reacting the above unsaturated carboxylic acids with a lower alcohol such as methanol, ethanol, propanol, n-butanol or isobutanol. Acrylic acid esters and methacrylic acid esters are especially preferred.

More specific examples of the unsaturated carboxylic acid ester in component (2) include methyl methacrylate, ethyl methacrylate, propyl methacrylate, butyl methacrylate, methyl acrylate, ethyl acrylate, propyl acrylate and butyl acrylate. The use of butyl acrylate (n-butyl acrylate, i-butyl acrylate) is especially preferred. A plurality of these unsaturated carboxylic acid esters may be used in combination.

More specific examples of the unsaturated carboxylic acid ester in component (2) include methyl methacrylate, ethyl methacrylate, propyl methacrylate, butyl methacrylate, methyl acrylate, ethyl acrylate, propyl acrylate and butyl acrylate. The use of butyl acrylate (n-butyl acrylate, i-butyl acrylate) is especially preferred. A plurality of these unsaturated carboxylic acid esters may be used in combination.

When preparing the above-described olefin-unsaturated carboxylic acid copolymer and olefin-unsaturated carboxylic acid-unsaturated carboxylic acid ester copolymer, optional monomers may also be copolymerized insofar as the objects of the invention are attainable.

The content of unsaturated carboxylic acid within these copolymers is preferably from 5 to 20 wt % in above component (1), and from 1 to 10 wt % in above component (2). Too low a content of unsaturated carboxylic acid may diminish the rigidity and rebound, thus decreasing the flight performance of the golf ball. On the other hand, to high a content of unsaturated carboxylic acid may result in a poor flexibility.

The content of unsaturated carboxylic acid ester in component (2) is preferably from 12 to 45 wt %. If the content of unsaturated carboxylic acid ester is too low, a softening effect may not be achieved. On the other hand, if the unsaturated carboxylic acid ester content is too high, the rebound may decrease.

If above component (1) and above component (2) are blended and used together, it is advantageous for these components to be used in a weight ratio (1)/(2) of preferably 100/0 to 25/75, and more preferably 100/0 to 50/50. The use of too much component (2) may result in a less than satisfactory rebound.

The ionomer resin is preferably one obtained by neutralizing the above-described copolymer with at least one type of metal ion having a valence of 1 to 3. Examples of metal ions having a valence of 1 to 3 that are suitable for neutralization include sodium, potassium, lithium, magnesium, calcium, zinc, aluminum, ferrous ions and ferric ions.

Such metal ions may be introduced by reacting the above-described copolymers with, for example, a hydroxide, methoxide, ethoxide, carbonate, nitrate, formate, acetate or oxide of the aforementioned valence 1 to 3 metals.

It is advantageous for the carboxylic acid included within the above copolymer to be neutralized with metal ions such that at least 10 mol %, preferably at least 30 mol %, and up to 100 mol %, preferably up to 90 mol %, of the carboxyl groups on the copolymer are neutralized. A low degree of neutralization may result in a low rebound.

From the standpoint of enhancing the rebound, it is desirable to use a univalent metal ionomer and a divalent metal ionomer in admixture. The former and the latter are preferably mixed and used together at this time in a weight ratio of 20/80 to 80/20.

Also, it is known that a good balance between resilience and durability can be achieved in a layer composed primarily of ionomer resin by blending suitable amounts of ionomer resins containing different monovalent, divalent or trivalent metal ionic species. Such blending is preferred in the practice of the invention.

The ionomer resin used in the invention may be a commercial product. Exemplary ionomer resins include Surlyn, which is produced by E.I. du Pont de Nemours and Co., Inc., and Himilan, which is produced by DuPont-Mitsui Polychemicals Co., Ltd.

In the practice of the invention, it is preferable to use an ionomer resin as component (A). Alternatively, an ionomer resin may be mixed and used together with the above-described thermoplastic resin or thermoplastic elastomer.

(B) Polyacetal

The polyacetal that is added may be (1) a homopolymer or (2) a copolymer. Of these, a polyacetal copolymer having excellent thermal stability is preferred. Homopolymers known to be used for this purpose include those composed of a monomer such as formalin (an aqueous solution of formaldehyde), anhydrous formaldehyde gas, or trioxane. Copolymers known to be used for this purpose include those composed of trioxane and a comonomer (e.g., ethylene oxide, 1,3-dioxolane, 1,4-butanediol formal, diethylene glycol formal).

(1) The homopolymers are represented by a structure such as $$\alpha\text{-O—}(CH_2O)n\text{-}\omega,$$

in which the α and ω ends may be, for example, $CH_3CO$— or $CH_3$—.

(2) The copolymers are represented by structures such as $$\alpha\text{-O—}[(CH_2O)\text{-ran-}(CH_2CH_2O)]\text{-}\omega,$$

$$\alpha\text{-O—}[(CH_2O)\text{-ran-}(CH_2CH_2CH_2CH_2O)]\omega, \text{ or}$$

$$\alpha\text{-O—}[(CH_2O)\text{-ran-}(CH_2CH_2OCH_2CH_2O)]\omega,$$

in which the α and ω ends may be, for example, $CH_3$—, $CH_3CH_2CH_2CH_2$—, HCO—, $HOCH_2CH_2$— or $HOCH_2CH_2CH_2CH_2$—.

Commercial products may be used as polyacetal materials composed of the above polymers. Examples of suitable polyacetal homopolymers include Tenac 5050 and Tenac 7010 (both available from Asahi Kasei Chemicals Corporation), and Delrin 500P (available from Du Pont). Examples of suitable polyacetal copolymers include Amilus S731 and Amilus S761 (both available from Toray Industries, Inc.), Duracon M140S (available from Polyplastics Co., Ltd.), and Tenac 7520 (available from Asahi Kasei Chemicals Corporation).

Above component (A) and component (B) are mixed in a ratio by weight of preferably 99:1 to 50:50, more preferably 99:1 to 80:20, and most preferably 95:5 to 85:15. If the proportion of component (B) is too small, the desired effects of the invention may not be sufficiently achieved. On the other hand, if the proportion of component (B) is too large, the resulting mixture may be difficult to knead or to mold into a golf ball cover. In cases where an additional polymer component other than above components (A) and (B) is also included in the mixture, it is preferable to adjust the proportion of component (B) within a range of 1 to 20 wt % of the overall resin.

The cover is composed primarily of above components (A) and (B), which account for generally at least 50 wt %, preferably at least 60 wt %, and more preferably at least 70 wt %, of the cover resin material. If necessary, other ingredients such as dyes, pigments (e.g., titanium dioxide, zinc oxide, barium sulfate), UV absorbers, antioxidants and dispersion aids may also be included in the cover material. Dispersion aids are exemplified by polyethylene waxes, metal soaps, fatty acid esters and fatty acid amides, and may be included in an amount, based on the overall cover material composition, of at least 0.2 wt %, and preferably at least 0.5 wt %, but not more than 10.0 wt %, and preferably not more than 5 wt %.

Formation of the cover may be carried out by a conventional method, such as a known injection molding method. For example, the golf ball may be obtained by placing the core within the required injection-molding mold, then injection molding the cover material around the core. If the cover has two or more layers, including an intermediate layer or outermost layer, a cover of two or more layers can be formed over the core by carrying out the above-described injection molding two or more times by a similar method. Alternatively, the cover may be formed by enclosing the core or an intermediate layer with two half-cups that have been molded beforehand as hemispherical shells, then molding under applied heat and pressure.

In the practice of the invention, the ball, when irradiated for 24 hours with a mercury vapor lamp, has a color difference ΔE of 2.00 or less, and preferably 1.85 or less. The color difference ΔE refers to the difference in the color of the ball after 24 hours of irradiation compared to before the ball is irradiated; a smaller value indicates a lower degree of color change. If the color difference ΔE of the ball is greater than 2.00, the degree of browning by the surface of the ball increases, i.e., the degree of color change increases, compromising the appearance. The mercury vapor lamp referred to above may be, for example, the H400-F mercury vapor lamp manufactured by Toshiba Corporation for use in color fading tests. Measurement of the color difference ΔE of the ball can be carried out in accordance with JIS Z 8701 using a known color difference meter.

The golf ball of the invention is preferably formed to a diameter and weight in accordance with the Rules of Golf, and is generally formed to a diameter of not less than 42.67 mm and a weight of not more than 45.93 g. The diameter is preferably from 42.67 to 42.9 mm. Deflection by the ball when subjected to a load of 980 N (100 kg) is preferably 2.0 to 4.0 mm, more preferably 2.2 to 3.8 mm, and most preferably 2.5 to 3.5 mm.

As described above, the golf ball of the invention has an excellent durability to repeated impact, and also has improved resistance to scuffing and to color change. In particular, for amateur golfers who do not have a high head speed, this is a competitively advantageous golf ball which is able to provide both an excellent flight performance and a good feel on impact.

EXAMPLES

The following Examples of the invention and Comparative Examples are provided by way of illustration and not by way of limitation.

Example 1, Comparative Example 1

In each example, a core material of the composition indicated in Table 1 below was masticated, then vulcanized and molded at 155° C. for 15 minutes to give a 35.3 mm diameter solid core.

TABLE 1

| | | Example 1 | Comparative Example 1 |
|---|---|---|---|
| Base rubber | BR01[1)] | 50 | 45 |
| | BR51[2)] | 50 | 45 |
| | IR[3)] | 0 | 10 |
| Zinc acrylate | | 24.0 | 24.0 |
| Peroxide (1)[4)] | | 0.6 | 0.6 |
| Peroxide (2)[5)] | | 0.6 | 0.6 |
| Antioxidant[6)] | | 0.1 | 0.1 |
| Zinc salt of pentachlorothiophenol | | 0.1 | 0.1 |
| Zinc oxide | | 5 | 5 |
| Barium sulfate | | 20.8 | 22.6 |

Amounts of components are given in parts by weight.
The core materials in Table 1 are described below.
BR01[1)]: A butadiene rubber produced by JSR Corporation under the trade name BR01.
BR51[2)]: A butadiene rubber produced by JSR Corporation under the trade name BR51.
IR[3)]: An isoprene rubber produced by JSR Corporation under the trade name IR2200.

TABLE 1-continued

| | Example 1 | Comparative Example 1 |
|---|---|---|

Peroxide (1)[4)]: Dicumyl peroxide, produced by NOF Corporation under the trade name Percumil D.
Peroxide (2)[5)]: 1,1-Bis(t-butylperoxy)-3,3,5-trimethyl-cyclohexane, produced by NOF Corporation under the trade name Perhexa 3M-40.
Antioxidant[6)]: 2,2-Methylenebis(4-methyl-6-tert-butylphenol), produced by Ouchi Shinko Chemical Industry Co., Ltd. under the trade name Nocrac NS-6.

Next, the starting materials shown in Table 2 below (units: parts by weight) were intimately mixed in a twin-screw extruder at a mixing temperature of 190 to 220° C. to form an intermediate layer material and cover materials. The core described above was placed within an injection-molding mold and the intermediate layer material was injection molded around the core. The cover material was then injection molded around the resulting spherical body so as to form a cover having numerous dimples on the outside surface thereof. A non-yellowing urethane resin paint was subsequently applied to the cover surface and dried, thereby giving three-piece solid golf balls in Example 1 of the invention and in Comparative Example 1.

TABLE 2

| | | Example 1 | Comparative Example 1 |
|---|---|---|---|
| Core | Diameter (mm) | 35.3 | 35.3 |
| | Weight (g) | 27.1 | 27.4 |
| | Deflection (mm) | 4.0 | 4.0 |
| Intermediate layer material | Hytrel 4047 | 100 | 100 |
| Intermediate layer | Shore D hardness | 40 | 40 |
| | Specific gravity | 1.12 | 1.12 |
| Spherical body (core enclosed by intermediate layer) | Outside diameter (mm) | 38.6 | 38.6 |
| Cover material | Himilan 1605 | 45 | |
| | Himilan 1706 | 45 | |
| | AM7317 | | 50 |
| | AM7318 | | 50 |
| | Amilus S731 | 10 | |
| | Magnesium stearate | 1 | 1 |
| | Titanium oxide | 2 | 2 |
| Cover | Shore D hardness | 65 | 65 |
| | Thickness (mm) | 2.05 | 2.05 |
| Finished product | Diameter (mm) | 42.7 | 42.7 |
| | Weight (g) | 45.19 | 45.19 |
| | Deflection (mm) | 2.9 | 2.9 |
| Evaluation | Durability to impact | 110 | 103 |
| | Scuff resistance | 4.2 | 3.1 |
| | Mercury vapor lamp irradiation, ΔE | 1.56 | 2.62 |

The materials in Table 2 are described below.
Hytrel 4047: A thermoplastic polyester elastomer produced by DuPont-Toray Co., Ltd.
Himilan 1605: An ionomer resin which is a sodium ion-neutralized ethylene-methacrylic acid copolymer produced by DuPont-Mitsui Polychemicals Co., Ltd.
Himilan 1706: An ionomer resin which is a zinc ion-neutralized ethylene-methacrylic acid copolymer produced by DuPont-Mitsui Polychemicals Co., Ltd.
AM7317: An ionomer resin which is a zinc ion-neutralized ethylene-methacrylic acid copolymer produced by DuPont-Mitsui Polychemicals Co., Ltd.
AM7318: An ionomer resin which is a sodium ion-neutralized ethylene-methacrylic acid copolymer produced by DuPont-Mitsui Polychemicals Co., Ltd.
Amilus S731: A copolymer-type polyacetal resin produced by Toray Industries, Inc.
Magnesium stearate: Produced by NOF Corporation.
Titanium oxide: Tipaque R550, produced by Ishihara Sangyo Kaisha, Ltd.

The tests in Table 2 that were carried out to evaluate the golf balls are described below.

Deflection (mm)

This is the amount of deformation (mm) by the spherical object when subjected to an increase in load from an initial load state of 98 N (10 kgf) to a final load of 1,275 N (130 kgf).

Cover Resin Hardness

The Shore D hardness measured in accordance with ASTM D-2240.

Durability to Repeated Impact

The golf balls were repeatedly hit at a head speed of 45 m/s with a W#1 club mounted on a swing robot. The golf club was a Tour Stage X-Drive Type 350 (loft, 10°) manufactured by Bridgestone Sports Co., Ltd. The durability of the golf ball to repeated impact is indicated in the table as the number of times the ball was hit before cracks began to form. The initial velocity of the ball was monitored each time it was hit, and the number of times the ball had been hit when its initial velocity fell 3% or more below the average initial velocity for the first ten times it was hit was treated as the number of impacts incurred by the ball when cracks began to appear. Each value shown in the table is an average obtained for six balls.

Scuff Resistance

A non-plated X-WEDGE 03 (loft, 52°) manufactured by Bridgestone Sports Co., Ltd. was set in a swing robot, and the ball was hit at a head speed of 33 m/s with the club face open about 30° from square. The surface state of the ball was then visually examined and rated according to the following criteria.

The ratings were obtained by averaging the individual scores assigned by three golfers having handicaps of 10 or less.

5: Surface of ball is either completely unchanged or bears a slight imprint from club face.

4: Surface of ball bears a clear imprint from club face, but is not frayed.

3: Surface is conspicuously frayed and scuffed.

2: Surface is frayed and cracked.

1: Some dimples have been obliterated.

Mercury Vapor Lamp Test

The test was carried out with an H400-F mercury vapor lamp manufactured by Toshiba Corporation for color fading tests. During the test, the distance between the light source and the ball was 30 cm, and the drum speed was 1 rpm. The surface of the ball was irradiated for 24 hours with the mercury vapor lamp. The change in color at the surface of the ball before and after irradiation was measured using a color difference meter (model MSC-IS-2DH) manufactured by Suga Test Instruments Co., Ltd., and the color difference ΔE for the ball before and after irradiation was determined based on the Lab color system in accordance with JIS Z 8701. A smaller color difference ΔE indicates less change in color.

The invention claimed is:

1. A golf ball, comprising a core and a cover of one or more layers which encloses the core, wherein at least one cover layer is made primarily of a mixture of (A) a thermoplastic resin or thermoplastic elastomer selected from the group consisting of polyester elastomers, polyamide elastomers, polyurethane elastomers, and ionomer resins consisting of a univalent metal ionomer and a divalent metal ionomer in admixture in a weight ratio of 20/80 to 80/20, and (B) a polyacetal which accounts for 1 to 20 wt % of resin components in the at least one cover layer.

2. The golf ball of claim 1, wherein component (A) and component (B) are mixed in a ratio by weight of from 99:1 to 80:20.

3. The golf ball of claim 1, wherein the cover of one or more layers has an outermost layer which is made of a cover material composed primarily of the mixture of components (A) and (B).

4. The golf ball of claim 1 which, when irradiated for 24 hours with a mercury vapor lamp, has a degree of fading ΔE of 2.00 or less.

5. The golf ball of claim 1, wherein component (B) is a polyacetal copolymer.

6. The golf ball of claim 1, wherein component (B) is a polyacetal copolymer composed of trioxane and a comonomer selected from the group consisting of ethylene oxide, 1,3-dioxolane, 1,4-butanediol formal, and diethylene glycol formal.

7. The golf ball of claim 1, wherein component (B) is a polyacetal homopolymer.

8. The golf ball of claim 1, wherein the core is made from a rubber composition comprising a polybutadiene having on a polymer chain thereof a cis-1,4 bond content of at least 60 wt %, unsaturated carboxylic acids and/or the metal salts of unsaturated carboxylic acids as a co-crosslinking agent, an organic peroxide, an inert filler and an organosulfur compound.

9. The golf ball of claim 8, wherein the polybutadiene of the core is synthesized with a lanthanide series rare earth catalyst or a group VIII metal compound catalyst.

10. The golf ball of claim 1, wherein (A) comprises a polyester elastomer having a hardness, as measured in accordance with ASTM D-2240 (Shore D hardness), of at least 10 and not more than 50, and a rebound resilience of at least 40% and not more than 90%, as measured in accordance with British Standard 903 (BS 903).

11. A golf ball, comprising a core and a cover of two or more layers including an intermediate layer and an outermost layer, wherein the intermediate layer is made primarily of polyester elastomers and the outermost layer is made primarily of a mixture of (A) ionomer resins consisting of a univalent metal ionomer and a divalent metal ionomer in admixture in a weight ratio of 20/80 to 80/20, and (B) a polyacetal which accounts for 1 to 20 wt % of resin components in the outermost layer.

12. The golf ball of claim 11, wherein component (A) and component (B) are mixed in a ratio by weight of from 99:1 to 80:20.

13. The golf ball of claim 11 which, when irradiated for 24 hours with a mercury vapor lamp, has a degree of fading ΔE of 2.00 or less.

14. The golf ball of claim 11, wherein component (B) is a polyacetal copolymer.

15. The golf ball of claim 11, wherein component (B) is a polyacetal copolymer composed of trioxane and a comonomer selected from the group consisting of ethylene oxide, 1,3-dioxolane, 1,4-butanediol formal, and diethylene glycol formal.

16. The golf ball of claim 11, wherein component (B) is a polyacetal homopolymer.

17. The golf ball of claim 11, wherein the core is made from a rubber composition comprising a polybutadiene having on a polymer chain thereof a cis-1,4 bond content of at least 60 wt %, unsaturated carboxylic acids and/or the metal salts of unsaturated carboxylic acids as a co-crosslinking agent, an organic peroxide, an inert filler and an organosulfur compound.

18. The golf ball of claim 17, wherein the polybutadiene of the core is synthesized with a lanthanide series rare earth catalyst or a group VIII metal compound catalyst.

* * * * *